166-274 SR

5/25/82 XR 4,331,202

United States Patent [19]

Kalina

[11] 4,331,202

[45] May 25, 1982

[54] METHOD FOR RECOVERY OF HYDROCARBON MATERIAL FROM HYDROCARBON MATERIAL-BEARING FORMATIONS

[76] Inventor: Alexander I. Kalina, 12439 Millbanks, Houston, Tex. 77031

[21] Appl. No.: 185,415

[22] Filed: Sep. 9, 1980

Related U.S. Application Data

[63] Continuation-in-part of Ser. No. 161,577, Jun. 20, 1980, abandoned.

[51] Int. Cl.[3] ..... E21B 43/24; E21B 43/30; E21B 43/40

[52] U.S. Cl. ..... 166/245; 166/266; 166/264; 166/270; 166/272; 166/273; 166/274; 166/300; 166/302; 166/303

[58] Field of Search ..... 166/252, 265, 266, 267, 166/270, 271, 272, 273, 274, 275, 300, 302, 303, 268, 305 R

[56] References Cited

U.S. PATENT DOCUMENTS

| | | | |
|---|---|---|---|
| 1,237,139 | 8/1917 | Yeomans | 166/272 X |
| 2,412,765 | 12/1946 | Buddrus et al. | 166/303 X |
| 3,101,781 | 8/1963 | Connally, Jr. | 166/273 |
| 3,111,984 | 11/1963 | Reisberg | 166/270 |
| 3,135,326 | 6/1964 | Santee | 166/272 |
| 3,185,214 | 5/1965 | Berna et al. | 166/270 |
| 3,259,187 | 7/1966 | Prats et al. | 166/270 |
| 3,333,632 | 8/1967 | Kyte | 166/272 |
| 3,384,177 | 5/1968 | Day et al. | 166/307 |
| 3,392,782 | 7/1968 | Ferrell et al. | 166/275 |
| 3,398,791 | 8/1968 | Hurd | 166/270 |
| 3,464,492 | 9/1969 | Friedman | 166/270 |
| 3,776,312 | 12/1973 | Nagy et al. | 166/302 |
| 3,929,192 | 12/1975 | Friedman | 166/300 |
| 3,938,590 | 2/1976 | Redford et al. | 166/270 |
| 4,004,636 | 1/1977 | Brown et al. | 166/272 |
| 4,058,164 | 11/1977 | Stoddard et al. | 166/303 |
| 4,110,224 | 8/1978 | Allen | 166/275 X |

FOREIGN PATENT DOCUMENTS

| | | | |
|---|---|---|---|
| 982282 | 2/1965 | United Kingdom | 166/272 |

*Primary Examiner*—Stephen J. Novosad
*Assistant Examiner*—George A. Suchfield
*Attorney, Agent, or Firm*—Arnold, White & Durkee

[57] ABSTRACT

A method of heating a hydrocarbon material contained in a recovery zone in an underground hydrocarbon material-bearing formation to reduce the viscosity thereof for facilitating recovery of the hydrocarbon material, in which a gaseous penetration medium comprising a gaseous working fluid and a carrier gas, is fed into the formation at a penetration pressure sufficient for penetration of the recovery zone, the working fluid being a water soluble gas which generates heat of solution upon absorption in an aqueous medium, and in which the partial pressure of the working fluid in relation to the penetration pressure and the temperature prevailing in the recovery zone is controlled to inhibit working fluid condensation but to provide for absorption of working fluid by water present in the formation to release heat for heating the hydrocarbon material in the recovery zone.

43 Claims, No Drawings

METHOD FOR RECOVERY OF HYDROCARBON MATERIAL FROM HYDROCARBON MATERIAL-BEARING FORMATIONS

REFERENCE TO RELATED APPLICATION

This application is a continuation-in-part application of my earlier co-pending application Ser. No. 161,577 filed June 20, 1980, now abandoned.

This invention relates to the recovery of hydrocarbon material from hydrocarbon material-bearing formations. More particularly, this invention relates to a method of heating a hydrocarbon material contained in an undergrond hydrocarbon material-bearing formation to reduce the viscosity thereof for facilitating recovery of the hydrocarbon material, and to a method of producing hydrocarbon material from such a subsurface formation.

This invention may have application generally in relation to hydrocarbon materials which are contained in hydrocarbon-bearing formations where the application of heat to reduce the viscosity of the hydrocarbon material would be advantageous to facilitate recovery of the material. This invention may therefore, for example, have particular application in regard to the recovery of oil or other hydrocarbon materials from a subsurface formation in the form of tar sand, oil sand or oil shale.

Various methods have been proposed for treating viscous oil deposits to facilitate recovery thereof. Some of the proposed methods rely on flooding of the formation with a liquid under pressure to drive the hydrocarbon material out of the formation. In the case of highly viscous hydrocarbon materials, water flooding techniques will tend to be largely ineffective.

Proposals have therefore been made to incorporate surface tension reducing agents or emulsifiers in flooding waters to reduce the surface tension of the hydrocarbon material or to form water in oil emulsions. While these proposals would be expected to improve recovery of such hydrocarbon materials, these techniques tend to be extremely expensive in view of the vast quantities of water which are required and thus the quantities of chemicals which need to be dissolved in the water.

Further proposals involve the use of flooding with liquid solvents for the hydrocarbon materials. These techniques again tend to be costly and present various disadvantages.

Further proposals involve the use of steam to heat the hydrocarbon material for the purpose of reducing its viscosity. While heating with steam can be effective, steam must of necessity be employed at high pressure to secure adequate penetration of the underground formation. Because of the high pressure, steam tends to condense upon introduction into the formation thereby inhibiting penetration of steam through the formation. In attempts to combat this problem, super heated steam has been employed to achieve adequate penetration before condensation occurs in the formation. This presents the serious disadvantage of the cost of producing super heated steam at high pressure. This presents the additional disadvantage that substantial and wasteful overheating of the hydrocarbon material in the immediate vicinity of the injection well where steam is introduced, will of necessity occur. The hydrocarbon material will therefore be heated to an excessively high temperature in the vicinity of the injection well, and the temperature will reduce gradually to the remote zones penetrated by the steam.

Proposals have been made to use liquid solvents or emulsification agents in conjunction with steam heating. These proposals do, however, not overcome essential economic disadvantages involved in the temperature gradient obtained in the formation, the substantial overheating of the hydrocarbon material in the vicinity of the injection zone, and the fact that once the steam has condensed, as would be the case with any other liquids employed, liquid penetration will be limited and will be substantially less than gas penetration.

It is accordingly one of the objects of this invention to provide a method for the treatment of hydrocarbon materials in underground formations in which penetration is facilitated by employing a gaseous rather than a liquid penetration medium, and in which heating may be controlled to heat a recovery zone in an underground formation to a generally uniform temperature without excessive and wasteful overheating of the formation in the vicinity of the injection zone and without an excessive temperature gradient through the recovery zone in the formation.

In accordance with one aspect of the invention, there is provided a method of heating a hydrocarbon material contained in a recovery zone in an underground hydrocarbon-bearing formation to reduce the viscosity of the hydrocarbon material for facilitating recovery thereof from the recovery zone, which comprises:

(a) feeding a gaseous penetration medium comprising a gaseous working fluid and a carrier gas, into the formation at a penetration pressure sufficient for effective penetration of the recovery zone, the working fluid being a water soluble gas which generates heat of solution upon absoprtion in an aqueous medium; and (b) controlling the partial pressure of the working fluid in the penetration medium in relation to the penetration pressure and the temperature prevailing in the recovery zone to inhibit working fluid condensation but to provide for absorption of working fluid by water present in the formation to release heat for heating the hydrocarbon material in the recovery zone.

The partial pressure of working fluid may be controlled by controlling the proportion of gaseous working fluid in the penetration medium not only to combat working fluid condensation, but also to limit the degree of absorption of working fluid by the water present in the formation, to thereby achieve generally uniform heating of the recovery zone without excessive overheating in excess of the temperature in the recovery zone, in the vicinity of the zone where the penetration medium is introduced into the formation.

By introducing the gaseous working fluid in admixture with a carrier gas, the proportion of working fluid in the penetration medium can be controlled to maintain the working fluid partial pressure below the pressure where working fluid will condense in the formation, while the overall pressure of the penetration medium may be sufficiently high to permit effective penetration of the gaseous penetration medium throughout the recovery zone.

Without such limitation on the partial pressure of the working fluid, if working fluid were to be introduced at a pressure sufficient to secure adequate penetration, the required pressure would usually tend to be above the condensation pressure of the working fluid at the temperature prevailing in the formation, thereby resulting in condensation of working fluid upon introduction into the formation. Once condensation occurs, further penetration of the liquid formed will be inhibited leading to the requirement of a yet higher pressure to obtain adequate penetration. The result will be that as the pressure of the working fluid is increased to improve penetration, more working fluid will condense to again inhibit penetration.

By further limiting the partial pressure of the working fluid to limit the degree of absorption of working fluid, a portion of the working fluid will be absorbed by the water upon introduction of the penetration medium to raise the temperature to a certain level from the heat of solution of the working fluid, until the water is saturated with working fluid at the pressure and temperature prevailing in that region. Further working fluid in the penetration medium will bypass that region until it comes into contact with colder water which is not saturated with working fluid, where working fluid will again dissolve. This process can continue throughout the recovery zone leading to a gradual and generally uniform heating of the recovery zone.

In the same way, if any region of the recovery zone cools down during the process, further working fluid will dissolve in the water in that region thereby providing for the maintenance of a generally uniform temperature throughout the recovery zone.

In the method of this invention, therefore, the partial pressure of the working fluid in the penetration medium may be increased by increasing the proportion of working fluid therein, in relation to the increase in temperature in the recovery zone to effect additional absorption of working fluid and a further increase in temperature in the recovery zone.

In one embodiment of the invention, the partial pressure of the working fluid may be increased gradually during feeding of the penetration medium to gradually increase the temperature in the recovery zone.

In an alternative embodiment of the invention, if dictated by prevailing conditions and the economics of the process, the partial pressure of the working fluid may be increased stepwise in one or more steps to provide a stepwise increase in temperature through the recovery zone.

The working fluid may be any gas or gas mixture which can be mixed with a carrier gas, which is soluble in water, and which is capable of generating heat upon dissolving in water to raise the temperature for heating hydrocarbon material in a recovery zone.

Of the various gases and gas mixtures which could be used, ammonia presents the advantages of being readily absorbable by water to generate a high heat of solution. Applicant believes, therefore, that ammonia would be the preferred working fluid.

The method of this invention requires the presence of sufficient water in the formation within the recovery zone, to absorb a sufficient quantity of working fluid for the heat of solution to heat the recovery zone to a required temperature.

The method of this invention may therefore include the step of, where necessary, introducing water or a brine solution into the recovery zone to provide a sufficient water content for absorbing working fluid.

Water or brine may be introduced by any conventional means conveniently as a preliminary step.

Alternatively, or additionally, water may be introduced while the process of this invention is being carried out.

In a specific embodiment of the invention, as hereinafter described, water may be introduced together with the gaseous ammonia, with water being in the form of steam.

It will be appreciated that the method of this invention will only be effective if the formation itself is permeable or if the formation has been treated to make it sufficiently permeable for effective penetration by the penetration medium.

Where necessary, the formation may be treated by any conventional method to make it sufficiently permeable, as a preliminary step to carrying out the method of this invention.

In an embodiment, where the formation is not sufficiently permeable, the formation may be fractured by conventional hydrofracturing techniques to simultaneously introduce water into the recovery zone.

The temperature at which the penetration medium is fed into the recovery zone will depend upon the temperature prevailing in the recovery zone, upon the economics involved in preheating of the penetration medium, and upon the necessity of preventing condensation of the working fluid in the recovery zone.

In one example of the invention, the penetration medium may be fed into the recovery zone generally at the temperature prevailing therein, or at a temperature below the temperature prevailing in the recovery zone to prevent lowering of the temperature of the penetration medium and thus combat condensation of the working fluid in the recovery zone.

However, if dictated by economic considerations, the penetration medium may be preheated and fed into the recovery zone at a temperature in excess of that prevailing in the recovery zone to provide for further heating of the hydrocarbon material in the recovery zone provided the partial pressure of the working fluid is controlled so that it will not condense upon being cooled when introduced into the recovery zone.

The carrier gas employed in the penetration medium may be any inert gas which may be used to contribute to the partial pressure of the penetration medium thereby limiting the partial pressure of the ammonia working fluid and yet providing a penetration medium at a sufficient pressure to penetrate the recovery zone. Alternatively, if desired, the carrier gas may be a gas which can participate to facilitate heating or recovery of the hydrocarbon material.

In one example of the invention, therefore, the carrier gas may be in the form of air or nitrogen. In an alternative example of the invention, the carrier gas may be in the form of water vapor to simultaneously introduce water into the recovery zone and to contribute to heating of the recovery zone by releasing heat upon absorption.

In yet a further alternative embodiment of the invention, the carrier gas may be in the form of a gas which can dissolve in the hydrocarbon material to further reduce its viscosity.

In this latter embodiment of the invention, therefore, the carrier gas may be a hydrocarbon gas capable of changing into a liquid phase when its partial pressure approaches the penetration pressure at the temperature to which the recovery zone is heated. Feeding of the penetration medium may therefore be continued to maintain the penetration pressure despite absorption of working fluid, thereby to effect liquefaction of the hydrocarbon gas and solution thereof in the hydrocarbon material to further reduce its viscosity.

The hydrocarbon gas which would be suitable for use, will depend upon the penetration pressure, the temperature prevailing in the formation, and the temperature to which the formation in the recovery zone and thus the hydrocarbon material in the recovery zone is to be raised.

Applicant believes that hydrocarbon gases such as methane, ethane, propane and the like, or mixtures of such hydrocarbon gases would be appropriate for this purpose under appropriate conditions prevailing within the recovery zone.

In an embodiment of the invention, the carrier gas may be completely replaced, or partially replaced with steam once the temperature in the recovery zone has been raised sufficiently to combat immediate condensation of steam upon introduction of the penetration medium into the formation.

By delaying the introduction of steam until the temperature has been raised sufficiently within the recovery zone, immediate condensation of the steam upon introduction, can be inhibited, thereby avoiding overheating of the formation in the vicinity of the introduction zone and reducing the resistance to penetration which would be presented by condensed steam.

Where steam is incorporated in the penetration medium, the partial pressure of the steam may again be controlled by controlling the proportion of steam in the penetration medium to effect adequate penetration of the recovery zone by the steam.

In an embodiment of the invention, the penetration medium may be fed into the recovery zone through an injection well. After the recovery zone has been heated to a required temperature to reduce the viscosity of the hydrocarbon material sufficiently for recovery, feeding of the penetration medium may be discontinued, and the hydrocarbon material of reduced viscosity may be recovered from the injection well.

In an alternative embodiment of the invention, the penetration medium may be fed into the recovery zone through at least one injection well, and the heated hydrocarbon material of reduced viscosity may be recovered through at least one production well which is spaced from the injection well.

The method may include the step of placing temperature monitors in the vicinity of the recovery zone to facilitate accurate monitoring of the temperature thereby permitting accurate control of the quantity and conditions under which the penetration medium is introduced into the recovery zone.

The method may include the step of recovering the hydrocarbon of reduced viscosity by conventional means, separating the ammonia solution from the hydrocarbon material, and recovering the ammonia therefrom for reuse.

The ammonia may be recovered from the ammonia solution by increasing the temperature of the solution to evaporate the ammonia and/or by reducing the pressure of the solution. The particular process employed will depend upon prevailing circumstances.

While the method of this invention may have application in regard to various types of hydrocarbon materials which require heating to reduce their viscosity to enable or facilitate their recovery, the invention may have particular application in regard to hydrocarbon materials contained in subterranean formation in the form of tar sand, oil sand or oil shale.

The invention further extends to a method of producing hydrocarbon material from a hydrocarbon material-bearing subsurface formation penetrated by at least one injection well, which comprises:

(a) feeding a gaseous penetration medium comprising gaseous ammonia and a carrier gas, into the information through the well at a penetration pressure sufficient for the medium to penetrate a recovery zone of the formation;

(b) maintaining the penetration pressure for the medium to penetrate through the recovery zone;

(c) controlling the proportion of ammonia in the medium to control the partial pressure of ammonia to combat condensation of ammonia but effect absorption of ammonia in water present in the recovery zone to release heat of solution for heating the hydrocarbon material and reducing its viscosity, the proportion of ammonia being controlled to heat the hydrocarbon material to a predetermined level; and (d) recovering the heated hydrocarbon material of reduced viscosity from the formation.

The method may comprise recovering the hydrocarbon material through at least one production well spaced from the injection well.

In one example of this embodiment of the invention, the heated hydrocarbon material may be recovered through a plurality of production wells arranged in spaced relationship about the injection well.

In an alternative example of the this embodiment of the invention, the penetration medium may be fed into the formation through a plurality of injection wells arranged in spaced relationship about the production well.

Applicant believes that the method of this invention can provide the advantage that the temperature of an extended recovery zone can be increased on a gradual basis over an extended period while adjusting the proportion of ammonia in the penetration medium thereby providing for effective heating of the recovery zone without wasteful overheating of the region of the formation in the vicinity of the introduction of the penetration medium.

Applicant believes that the temperature can be increased gradually and generally substantially uniformly throughout the recovery zone thereby combating excessive heat loss.

Applicant believes that significant advantages can be provided by gradually or successively adjusting the partial pressure of ammonia to achieve a gradual or stepwise increase in temperature throughout the recovery zone.

Applicant further believes that by introducing steam with ammonia only once the recovery zone has been heated to a sufficient temperature to combat immediate condensation of steam upon introduction, and further by controlling the partial pressure of steam to limit condensation, substantial advantages can be achieved.

While it is believed that ammonia would be the preferred working fluid because of the fact that it generates a substantial heat of solution upon absorption in water, other working fluids which, while less effective, may also be employed either alone or in admixture. Thus, for example, sulfur trioxide or an alkali metal halide may be used for absorption in water or in an aqueous solution.

In yet a further embodiment of the invention, a solvent other than water may be introduced into a recovery zone, and a corresponding working fluid capable of being absorbed by the solvent to release heat, may be employed.

In this embodiment of the invention, the solvent may, for example, be a hydrocarbon liquid, while the working fluid may be a hydrocarbon gas, the partial pressure of which can be controlled to effect absorption and inhibit condensation in accordance with this invention.

The invention therefore extends to such a method which comprises introducing a solvent into a recovery zone, feeding a gaseous penetration medium comprising a gaseous working fluid and a carrier gas into the recovery zone at a penetration pressure sufficient for the medium to penetrate through the recovery zone, the working fluid being a fluid capable of being absorbed by the solvent to generate heat, and controlling the partial pressure of the working fluid in the penetration medium to combat condensation of the working fluid but effect absorption thereof in the solvent.

The recovery of hydrocarbon material from the formation may include the steps of feeding flooding water and gaseous ammonia separately to the formation, mixing the gaseous ammonia with the flooding water prior to penetration of the water through the formation for the ammonia to be absorbed by the water to heat the water, causing the heated flooding water to flood through a recovery zone of the formation, and recovering hydrocarbon material flooded from the recovery zone.

In this embodiment of the invention the feeding of gaseous ammonia and flooding water may conveniently be commenced only once the recovery zone of the formation has been heated to a predetermined level where the hydrocarbon material is sufficiently heated for effective recovery.

Sufficient ammonia is preferably introduced for absorption by the flooding water to heat the flooding water to the temperature of the recovery zone of the formation, thereby preventing the flooding water from cooling the heated recovery zone.

If the pressure required to flood the flooding water through the recovery zone is such that the gaseous ammonia will tend to condense prior to mixing with the flooding water, the pressure of the ammonia may be limited for the ammonia to remain substantially in gaseous form until it mixes with the flooding water and is absorbed thereby, by introducing the gaseous ammonia in admixture with a carrier gas as a penetration medium, and controlling the proportion of ammonia in the penetration medium to limit the partial pressure of the ammonia.

By ensuring that the ammonia remains in gaseous form until it is absorbed by the flooding water, the flooding water can be heated to the maximum extent immediately prior to flooding of the recovery zone with the heated flooding water.

In this way the flooding water can be heated most effectively to the temperature prevailing in the recovery zone thereby avoiding cooling of the heated recovery zone during flooding, and combating wasteful heat loss which would occur if the ammonia were allowed to condense before mixing with the flooding water.

In a preferred embodiment of the invention the gaseous ammonia and the flooding water are fed separately to the formation through separate well zones of at least one injection well leading to the formation, and the ammonia gas and flooding water are mixed in a downhole region prior to penetration of the heated flooding water into the recovery zone.

In this embodiment the flooding water may, for example, be fed in through an annulus of the injection well while the gaseous ammonia is fed through the injection well piping. In the region where the injection well is in communication with the formation, the piping may be in communication with the annulus for mixing to occur.

The heated hydrocarbon material may preferably be recovered from the recovery zone through at least one production well leading to the recovery zone and spaced from the injection well.

In a specific embodiment of the invention flooding of the heated flooding water is continued for a period, whereafter feeding of the gaseous ammonia is discontinued while flooding with the flooding water is continued for the relatively cool flooding water to absorb ammonia remaining in the recovery zone and encourage further recovery of hydrocarbon material from the recovery zone, thereby permitting ammonia to be recovered from the flooding water for re-use.

In one example of the invention the flooding water may be a brine solution.

The invention further extends to a method of heating a hydrocarbon material contained in an underground hydrocarbon material bearing formation to facilitate recovery thereof, which comprises feeding a solvent for a working fluid to the formation at a pressure sufficient for the solvent to penetrate the formation; simultaneously feeding a gaseous working fluid to the formation, the working fluid being a fluid capable of being absorbed by the solvent to generate heat upon absorption by the solvent; mixing the gaseous working fluid with the solvent prior to penetration of the solvent into the formation for the working fluid to be abosrbed by the solvent to heat the solvent; and causing the heated solvent to penetrate the formation to heat the hydrocarbon material in the formation; the working fluid being fed at a sufficiently low pressure for the working fluid to remain substantially in gaseous form until it mixes with the solvent and is absorbed thereby.

In a preferred embodiment of the invention the working fluid comprises gaseous ammonia and the solvent comprises water or brine. It will be appreciated, however, that any suitable conveniently available solvent may be employed, and any suitable gaseous working fluid which is compatible with the solvent may be employed.

In a preferred embodiment of the invention flooding of the heated solvent is continued for a period, whereafter feeding of the gaseous working fluid is discontinued while flooding with the solvent is continued for the relatively cool solvent to absorb working fluid remaining in the deposit and encourage further recovery of hydrocarbon material from the deposit.

In one example of the invention the working fluid and the solvent may be fed intermittently to the formation.

If desired, an excess of working fluid, in excess of the quantity capable of being absorbed by the solvent, may be fed to the formation, for the excess working fluid to penetrate the formation to be absorbed by solvent present in the formation to further heat the formation.

Flooding of the recovery zone by means of flooding water heated in accordance with this invention, can provide the advantages that where the recovery zone has been preheated, effective flooding can be effected without cooling of the recovery zone, while where the recovery zone has not been pre-heated, heating of the recovery zone can be effected to reduce the viscosity of the hydrocarbon material while it is being flooded.

By introducing cool flooding water or brine solution, and simultaneously separately introducing gaseous working fluid or ammonia, and mixing them in a downhole region proximate the recovery zone, effective heating of the flooding medium can be achieved while avoiding wasteful thermal losses in the pipeline.

When carrying out this invention, the penetration medium will tend to penetrate preferentially through the more permeable zones of the formation, However, because the penetration medium is gaseous and because of the pressure differential between the more permeable and less permeable formation zones, the working fluid will nevertheless tend to penetrate into the lesser permeable or dead zones of the formation.

The working fluid, particularly where it is in the form of gaseous ammonia, will therefore tend to be absorbed by water present in the lesser permeable or dead zones, thereby producing heat to heat the hydrocarbon material in the dead zones thereby facilitating recovery of hydrocarbon material from the dead zones.

In addition, if a pre-heated recovery zone is treated with a heated flooding medium as described in the specification, flooding may be continued until such time as the proportion of hydrocarbon material contained in the recovered flooding medium has dropped below an economical recovery level. Thereafter, as described, the recovery zone may be washed or flooded with a cool solvent, water or brine solution. During such washing operation, remaining working fluid or ammonia contained in the recovery zone will tend to be absorbed by the cool washing medium. At the same time, because of the working fluid or ammonia pressure differential between the working fluid or ammonia in the more permeable zones and in the lesser permeable or dead zones of the formation, working fluid or ammonia will tend to move into the more permeable zones for absorption by the solvent, water or brine solution, as the case may be.

Applicant believes that this will have the effect of facilitating further hydrocarbon material to move out of the dead zones thereby permitting recovery thereof.

Working fluid or ammonia, as the case may be, may then be recovered from the recovered washing fluid, for re-use.

Embodiments of the invention are now described by way of illustration with reference to certain theoretical calculations which have been made.

The theoretical calculations have been made using standard water/ammonia mixture enthalpy concentration diagrams.

The calculations have been made on the assumption that, in a typical case, the initial temperature in the recovery zone is say 40° C. to 60° C., and that the penetration pressure to achieve effective penetration of the penetration medium through the recovery zone is 50 atmospheres.

EXAMPLE 1

In this example, the temperature of the recovery zone is increased from 60° C. to 145° C. in a single step by employing ammonia gas as the working fluid, and by employing air as the carrier gas.

The penetration medium is introduced at a temperature marginally below 60° C. with the concentration of ammonia in the penetration medium such that the ammonia partial pressure is 16 atmospheres.

This partial pressure is sufficiently low that the ammonia will not condense in the recovery zone, but will be absorbed by water in the recovery zone.

As the penetration medium is fed into the recovery zone, ammonia will be absorbed by the water to release heat of solution. Once the concentration of ammonia in the water has reached 20% by weight, the temperature of the water will have risen to about 145° C. and the water will be saturated with ammonia at that temperature and pressure.

Once the concentration of ammonia in water has reached 20% by weight in any area of the recovery zone, the temperature will have been increased to about 145° C. and no further ammonia will be absorbed by the water in that zone. In this way, the recovery zone will be heated, generally uniformly without overheating of any specific zones within the recovery zone.

It follows therefore that generally uniform heating of the desired recovery zone can be effected by causing ammonia to be absorbed until the ammonia concentration is 20% by weight in the water throughout the recovery zone.

At a temperature of 145° C. hydrocarbon material in such a recovery zone would have been heated sufficiently for its viscosity to be reduced sufficiently to permit effective recovery thereof.

It follows for the above that if the initial temperature is less than 60° C., then the required final temperature of 145° C. cannot be reached in a single step. In this case the final temperature which can be achieved will be about 130° C. if the initial temperature is about 40° C.

EXAMPLE 2

In this example, in contrast with Example 1, the recovery zone is heated stepwise up to the required temperature of about 145° C. from an initial temperature of 40° C. in the recovery zone.

In this example, the penetration medium is introduced into the recovery zone marginally below a temperature of 40° C. with the proportion of ammonia in the penetration medium being such that the ammonia partial pressure is about 2 atmospheres.

At this pressure and temperature, the partial pressure is sufficiently low to prevent condensation of ammonia within the recovery zone.

During introduction of the penetration medium, ammonia will be absorbed by the water to heat the water up to about 90° C. Once water in a particular area of the recovery zone has been heated to about 90° C., it will be saturated with ammonia at that temperature and pressure, and no further ammonia will be absorbed. The ammonia contained in the penetration medium will therefore be carried to cooler zones which are not saturated, for ammonia to be absorbed by water in those cooler zones.

This will continue until the temperature throughout the recovery zone is generally uniformly in the region of about 90° C.

Thereafter the temperature of the penetration medium may be increased to approximately 90° C., while the proportion of ammonia in the penetration medium may be increased to provide an ammonia partial pressure of about 10 atmospheres.

This composition of penetration medium may then be fed into the recovery zone for absorption by water until the temperature of the recovery zone is increased to about 130° C.

Thereafter, the temperature of the penetration medium may be increased to about 130° C., while the proportion of ammonia may be increased to provide a partial pressure of about 15 atmospheres.

The third composition penetration medium may then be introduced into the recovery zone for further ammonia to be absorbed until the recovery zone has been heated to approximately 145° C.

At that stage, substantially the same temperature would have been achieved in Example 2 as in Example 1, except that the temperature will have been raised from about 40° C. (as compared to 60° C. in Example 1).

While relatively less ammonia will have been employed in Example 2 than in Example 1 to achieve the same final temperature, the heating process in Example 2 would take longer than in Example 1. Furthermore, in Example 2, the cost of preheating the second and third penetration medium compositions would have to be taken into consideration.

In practice therefore, whether a single or multistage process would be preferable, will depend largely upon considerations such as the temperature, the nature and the location of the formation from which the hydrocarbon material is to be recovered.

In an alternative embodiment of this example of the invention, once the recovery zone has been heated to about 90° C., instead of introducing the penetration medium at about 90° C., with an ammonia partial pressure of about 10 atmospheres, some steam may be incorporated in the penetration medium.

By including steam, some of the ammonia may be replaced by steam to reduce the quantity of ammonia used and yet still achieve effective heating.

Thus, in this embodiment, the penetration medium may have a temperature of about 90° C., an ammonia partial pressure of about 9.5 atmospheres, and a steam partial pressure of about 0.5 atmospheres. At the prevailing temperature and pressure, the partial pressure of the steam is low enough to prevent condensation thereof in the recovery zone. The steam can thus be carried through the recovery zone and will be absorbed by water therein to release heat through the recovery zone.

In the same way, once the temperature has been increased to about 130° C., some of the ammonia in the penetration medium employed at this temperature, may again be replaced with steam at an appropriate partial pressure.

EXAMPLE 3

In this Example of the invention the penetration medium may comprise a carrier gas with ammonia which is introduced marginally below the temperature prevailing in the recovery zone. The partial pressure of ammonia is controlled to provide a generally uniform temperature throughout the recovery zone in excess of about 80° C. either in a single or multistep process.

Once the recovery zone has been heated to a temperature in excess of about 80° C., the temperature of the penetration medium is increased to the temperature prevailing in the recovery zone, the partial pressure of ammonia is increased to effect a desired degree of absorption of ammonia by water in the recovery zone and, in addition, some of the carrier gas is replaced with steam. The proportion of steam is limited so that the partial pressure of steam in the penetration medium will be sufficiently low to prevent condensation of steam upon introduction into the recovery zone.

In this way the penetration medium will penetrate throughout the recovery zone while further ammonia is absorbed by water in the recovery zone to further increase the temperature of the recovery zone. At the same time, steam will penetrate through the recovery zone and will be absorbed by water in the recovery zone to further increase the temperature of the recovery zone.

By limiting the partial pressure of steam, condensation thereof upon introduction into the recovery zone is prevented thereby insuring that effective penetration of steam through the recovery zone will not be restricted by condensation of steam upon introduction into the recovery zone.

Once the temperature in the recovery zone has been uniformly increased, the temperature of the penetration medium may be increased, the proportion of ammonia may be increased and, in addition, the proportion of steam may be increased to raise the temperature of the recovery zone to a yet higher level.

While the process has been described in relation to a stepwise increase of the temperature of the penetration medium and the proportions of ammonia and steam, it will be appreciated that effective heating may be achieved by gradually increasing the temperature of the penetration medium, the proportion of ammonia and the proportion of steam in relation to the increase in temperature in the recovery zone.

By incorporating steam only when the temperature in the recovery zone has been raised sufficiently to prevent undesired steam condensation in the vicinity of the introduction zone, effective utilization of the heat provided by the steam throughout the recovery zone can be achieved and, in particular, wasteful and excessive overheating of the recovery zone in the vicinity of the introduction zone, can be prevented.

Once the temperature of the recovery zone has been increased to above about 100° C., significant quantities of steam can be included in the penetration medium to reduce the ammonia requirements while contributing to heating of the recovery zone.

It will be appreciated that the extent of the recovery zone in any particular instance will be based essentially on the location and nature of the formation. If drilling is expensive then injection and production wells would tend to be spaced further apart requiring that larger recovery zones be heated. On the other hand, if injection and production wells can economically be provided close to each other, then smaller recovery zones may be heated.

It will further be appreciated that the fewer steps employed in raising the temperature of the recovery zone up to the required temperature, the greater will be the quantities of ammonia required to be dissolved in water in the recovery zone but the shorter will be the heating period.

In practice therefore, the number of steps to be employed will be determined largely on the basis of economic optimization.

By incorporating steam in the penetration medium at an appropriate temperature and partial pressure, more economical heating could, in certain circumstances, be achieved. Once the temperature has been raised sufficiently, if the required penetration pressure is sufficiently low, it is possible that the carrier gas may be replaced entirely with steam. It is believed, however, that under normal conditions, this will not be feasible since the penetration pressure for effective penetration would usually tend to be too high.

Unless the partial pressure of the working fluid is controlled as described herein, the disadvantages of overheating, lack of control of heating, lack of effective penetration and excessive working fluid requirements are presented.

Thus, if an attempt were made to heat a recovery zone using pure gaseous ammonia as the working fluid, the results would be as follows:

If the recovery zone is at an initial temperature of about 40° C. and the pressure necessary for penetration of the recovery zone is about 50 atmospheres, the pure ammonia would have to be introduced at a temperature of about 90° C. for it to be in a gaseous state.

Upon introduction the ammonia would initially tend to condense in the injection well. Further, upon introduction into the recovery zone, ammonia will be absorbed by water in the vicinity of the introduction zone and will also condense in that zone. The temperature in that zone will be increased to between about 210° and 230° C. while an aqueous ammonia solution having an ammonia concentration of about 50% by weight will form.

Once this has occurred, ammonia can pass further into the recovery zone for the same process to occur, and so on.

It is clear therefore that substantial overheating will occur, that the extent of heating cannot be controlled, that excessive quantities of ammonia will be absorbed and dissolved, and that gaseous ammonia penetration will be inhibited.

Pure gaseous ammonia could therefore only be employed if, by chance, the initial temperature of the recovery zone is say 40° C. or 50° C., and the penetration pressure required for effective penetration is as low as 15 or 20 atmospheres respectively.

The complete embodiment of the process in accordance with this invention, comprising heating of a recovery zone, followed by flooding of the recovery zone with a heated flooding solution, followed by washing of the recovery zone with a cool washing solution, and including recovery of the working fluid for re-use, provides a comprehensive method of recovering hydrocarbon material from an underground hydrocarbon bearing formation in which heating of the formation can be achieved in an effective and controlled manner, in which the pre-heated formation can be flooded with a flooding medium which has been heated in an effective manner, and in which the mediums employed can be recovered for re-use.

What is claimed is:

1. A method of heating a hydrocarbon material contained in a recovery zone in an underground hydrocarbon material-bearing formation to reduce the vicinity of the hydrocarbon material for facilitating recovery thereof from the recovery zone, which comprises:

(a) feeding a gaseous penetration medium comprising a gaseous working fluid and a carrier gas, into the formation at a penetration pressure sufficient for penetration of the recovery zone, the working fluid being a water soluble gas which generates heat of solution upon absorption in an aqueous medium; and (b) controlling the partial pressure of the working fluid in the penetration medium in relation to the penetration pressure and the temperature prevailing in the recovery zone to inhibit working fluid condensation but to provide for absorption of working fluid by water present in the formation to release heat for heating the hydrocarbon material in the recovery zone.

2. A method according to claim 1, in which the partial pressure is controlled by controlling the proportion of gaseous working fluid in the penetration medium to limit the degree of absorption of working fluid by the water and thereby achieve generally uniform heating of the recovery zone without overheating to a substantially higher level in the vicinity of the zone where the penetration medium is introduced into the formation.

3. A method according to claim 1, in which the partial pressure of the working fluid in the penetration medium is increased in relation to the increase in temperature in the recovery zone to effect additional absorption of working fluid and a further increase in temperature in the recovery zone.

4. A method according to claim 3, in which the penetration medium is fed into the recovery zone at a temperature below that of the recovery zone and in which the temperature of the penetration medium is increased in relation to the increase in temperature in the recovery zone.

5. A method according to claim 4, in which the partial pressure of the working fluid is increased gradually during feeding of the penetration medium to gradually increase the temperature in the recovery zone, and in which the temperature of the penetration medium is increased gradually as the temperature increases in the recovery zone.

6. A method according to claim 4, in which the partial pressure of the working fluid is increased stepwise to provide a stepwise increase in temperature in the recovery zone, and in which the temperature of the penetration medium is increased stepwise in relation to the stepwise increase in temperature in the recovery zone.

7. A method according to claim 1, which includes the preliminary step of introducing water into the recovery zone to provide a sufficient water content for absorbing the working fluid.

8. A method according to claim 1, which includes the preliminary step of fracturing the recovery zone to provide for penetration thereof by the penetration medium.

9. A method according to claim 8, in which fracturing is effected by hydrofracturing to simultaneously introduce water into the recovery zone.

10. A method according to claim 1, in which the carrier gas is air, nitrogen, water vapor, or a hydrocarbon gas.

11. A method according to claim 1, in which the carrier gas is a hydrocarbon gas capable of changing into a liquid phase when its partial pressure approaches the penetration pressure at the temperature to which the recovery zone is heated, and in which feeding of the penetration medium is continued to maintain the penetration pressure despite absorption of working fluid to effect liquefaction of the hydrocarbon gas and solution thereof in the hydrocarbon material to further reduce its viscosity.

12. A method according to claim 1, in which the carrier gas is at least partially replaced with steam once the temperature in the recovery zone has been raised sufficiently to combat immediate condensation of steam upon introduction of the penetration medium into the formation.

13. A method according to claim 12, in which the partial pressure of the steam is controlled to limit steam penetration through the recovery zone.

14. A method according to claim 13, in which the partial pressure of steam is increased after the recovery zone has been heated, to further increase the temperature of the recovery zone.

15. A method according to claim 1, in which the penetration medium is fed into the recovery zone through an injection well, and in which, after heating of the hydrocarbon material, the hydrocarbon material is recovered from the injection well.

16. A method according to claim 1, in which the penetration medium is fed into the recovery zone through at least one injection well, and in which the heated hydrocarbon material is recovered through at least one production well.

17. A method according to claim 15 or claim 16, which includes the step of recovering the hydrocarbon material, separating the working fluid solution from the hydrocarbon material, and recovering the working fluid for re-use.

18. A method according to claim 1, in which the working fluid is ammonia.

19. A method according to claim 1, in which the hydrocarbon material is in the form of tar sand, oil sand or oil shale.

20. A method of producing hydrocarbon material from a hydrocarbon material-bearing subsurface formation penetrated by at least one injection well, which comprises:

(a) feeding a gaseous penetration medium comprising gaseous ammonia and a carrier gas, into the formation through the well at a penetration pressure sufficient for the medium to penetrate a recovery zone of the formation;

(b) maintaining the penetration pressure for the medium to penetrate through the recovery zone;

(c) controlling the proportion of ammonia in the medium to control the partial pressure of ammonia to inhibit condensation of ammonia but effect absorption of ammonia in water present in the recovery zone to release heat of solution for heating the hydrocarbon material and reducing its viscosity, the proportion of ammonia being controlled to heat the hydrocarbon material to a predetermined level; and (d) recovering the hydrocarbon material of reduced viscosity from the formation.

21. A method according to claim 20, in which the hydrocarbon material is recovered through at least one production well spaced from the injection well.

22. A method according to claim 21, in which the hydrocarbon material is recovered through a plurality of production wells arranged in spaced relationship about the injection well.

23. A method according to claim 21, in which the penetration medium is fed into the formation through a plurality of injection wells arranged in spaced relationship about the production well.

24. A method according to claim 20, in which the penetration medium is initially introduced into the recovery zone at a temperature below that prevailing initially in the recovery zone, in which the temperature of the penetration medium is increased in relation to the increase in temperature in the recovery zone, and in which the partial pressure of ammonia in the penetration medium is increased in relation to the increase in temperature in the recovery zone.

25. A method according to claim 24, in which the temperature of the penetration medium and the partial pressure of ammonia in the penetration medium is increased in a plurality of steps for a stepwise increase in temperature in the recovery zone.

26. A method according to claim 20, in which the recovery of hydrocarbon material from the formation includes the steps of feeding flooding water and gaseous ammonia separately to the formation, mixing the gaseous ammonia with the flooding water prior to penetration of the water through the formation for the ammonia to be absorbed by the water to heat the water, causing the heated flooding water to flood through a recovery zone of the formation, and recovering hydrocarbon material flooded from the recovery zone.

27. A method according to claim 26, in which the feeding of gaseous ammonia and flooding water is commenced only once the recovery zone of the formation has been heated to a predetermined level.

28. A method according to claim 27, in which sufficient ammonia is introduced for absorption by the flooding water, to heat the flooding water to the temperature of the recovery zone of the formation.

29. A method according to claim 26, in which the pressure of the ammonia is limited for the ammonia to remain substantially in gaseous form until it mixes with the flooding water and is absorbed thereby, by introducing the gaseous ammonia in admixture with a carrier gas as a penetration medium, and controlling the proportion of ammonia in the penetration medium to limit the partial pressure of the ammonia.

30. A method according to claim 26, in which the gaseous ammonia and the flooding water are fed separately to the formation through separate well zones of at least one injection well leading to the formation, and in which the ammonia gas and flooding water are mixed in a downhole region prior to penetration of the heated flooding water into the recovery zone.

31. A method according to claim 26, in which the heated hydrocarbon material is recovered from the recovery zone through at least one production well leading to the recovery zone and spaced from the injection well.

32. A method according to claim 31, in which flooding of the heated flooding water is continued for a period, whereafter feeding of the gaseous ammonia is discontinued while flooding with the flooding water is continued for the relatively cool flooding water to absorb ammonia remaining in the recovery zone and encourage further recovery of hydrocarbon material from the recovery zone, and in which ammonia is recovered from the flooding water.

33. A method according to claim 26, in which the flooding water is a brine solution.

34. A method of heating a hydrocarbon material contained in a recovery zone in an underground hydrocarbon material-bearing formation to reduce the viscosity of the hydrocarbon material for facilitating recovery thereof from the recovery zone, which comprises:

(a) introducing a solvent into the recovery zone;

(b) feeding a gaseous penetration medium comprising a gaseous working fluid and a carrier gas, into the formation at a penetration pressure sufficient for penetration of the recovery zone, the working fluid being a fluid capable of being absorbed by the solvent to generate heat upon absorption in the solvent; and (c) controlling the partial pressure of the working fluid in the penetration medium in relation to the penetration pressure and the temperature prevailing in the recovery zone to inhibit working fluid condensation but to provide for absorption of working fluid by the solvent to release heat for heating the hydrocarbon material in the recovery zone.

35. A method according to claim 34, which includes the steps of recovering heated hydrocarbon material from the recovery zone by, after the recovery zone has been heated to a predetermined level, feeding flooding water and a gaseous working fluid separately to the recovery zone, mixing the working fluid in gaseous form with the flooding water prior to penetration of the flooding water into the recovery zone for the working fluid to be absorbed by the water to heat the flooding water, causing the heated flooding water to flood through the recovery zone, and recovering the hydrocarbon material from at least one production well in communication with the recovery zone.

36. A method of heating a hydrocarbon material contained in an underground hydrocarbon material bearing formation to facilitate recovery thereof, which comprises:

(a) feeding a solvent for a working fluid to the formation at a pressure sufficient for the solvent to penetrate the formation;

(b) simultaneously feeding a gaseous working fluid to the formation, the working fluid being a fluid capable of being absorbed by the solvent to generate heat upon absorption by the solvent;

(c) mixing the gaseous working fluid with the solvent prior to penetration of the solvent into the formation for the working fluid to be absorbed by the solvent to heat the solvent; and (d) causing the heated solvent to penetrate the formation to heat the hydrocarbon material in the formation;

the working fluid being fed at a sufficiently low pressure for the working fluid to remain substantially in gaseous form until it mixes with the solvent and is absorbed thereby by introducing the gaseous working fluid in admixture with a carrier gas as a penetration medium, and controlling the proportion of working fluid in the penetration medium to limit the partial pressure of the working fluid.

37. A method according to claim 36, in which the working fluid comprises gaseous ammonia and the solvent comprises water or brine.

38. A method according to claim 36 or claim 37, in which the solvent and working fluid are fed to the formation through separate well zones of at least one injection well, in which the heated solvent is flooded through a recovery zone of the formation, and in which hydrocarbon material is produced from at least one production well spaced from the injection well.

39. A method according to claim 38, in which flooding of the heated solvent is continued for a period, whereafter feeding of the gaseous working fluid is discontinued while flooding with the solvent is continued for the relatively cool solvent to absorb working fluid remaining in the deposit and encourage further recovery of hydrocarbon material from the deposit, and in which working fluid is recovered from the solvent produced from the production well.

40. A method according to claim 36 or claim 37, in which an excess of working fluid, in excess of the quantity capable of being absorbed by the solvent, is fed to the formation, for the excess working fluid to penetrate the formation to be absorbed by solvent present in the formation to further heat the formation.

41. A method according to claim 36, in which the solvent and the working fluid are fed separately to the formation through separate well zones in at least one injection well leading to the formation, and in which the solvent and working fluid are mixed in a downhole region of the well where the well is in communication with the formation.

42. A method according to claim 36, in which the working fluid and the solvent are fed intermittently to the formation.

43. A method of heating a hydrocarbon material contained in an underground hydrocarbon material bearing formation to facilitate recovery thereof, which comprises:

(a) feeding a solvent for a working fluid to the formation at a pressure sufficient for the solvent to penetrate the formation, the solvent comprising water or a brine solution;

(b) simultaneously feeding a gaseous working fluid comprising ammonia to the formation, the working fluid being fed at a sufficiently low pressure for the working fluid to remain substantially in gaseous form until it mixes with the solvent and is absorbed thereby;

(c) mixing the gaseous working fluid with the solvent prior to penetration of the solvent into the formation for the working fluid to be absorbed by the solvent to heat the solvent;

(d) causing the heated solvent to penetrate the formation to heat the hydrocarbon material in the formation; and (e) feeding an excess of working fluid, in excess of the quantity capable of being absorbed by the solvent, to the formation, for the excess working fluid to penetrate the formation to be absorbed by solvent present in the formation to further heat the formation.

* * * * *

UNITED STATES PATENT AND TRADEMARK OFFICE

CERTIFICATE OF CORRECTION

PATENT NO. : 4,331,202

DATED : May 25, 1982

INVENTOR(S) : Alexander I. Kalina

It is certified that error appears in the above—identified patent and that said Letters Patent is hereby corrected as shown below:

Column 5, line 65, please delete "formation" and insert --formations--.

Column 13, line 50, please delete "vicinity" and insert --viscosity--.

Signed and Sealed this

*Eighteenth* Day of *January 1983*

[SEAL]

*Attest:*

GERALD J. MOSSINGHOFF

*Attesting Officer*

*Commissioner of Patents and Trademarks*